US007963511B2

(12) United States Patent
Meda

(10) Patent No.: US 7,963,511 B2
(45) Date of Patent: Jun. 21, 2011

(54) APPARATUS FOR MOVING AND POSITIONING OBJECTS TO BE PRESS LAMINATED

(75) Inventor: Carlo Meda, Bussero (IT)

(73) Assignee: Italpresse S.p.A., Bagnatica (IT)

( * ) Notice: Subject to any disclaimer, the term of this patent is extended or adjusted under 35 U.S.C. 154(b) by 1028 days.

(21) Appl. No.: 11/783,135

(22) Filed: Apr. 6, 2007

(65) Prior Publication Data

US 2007/0241006 A1 Oct. 18, 2007

(30) Foreign Application Priority Data

Apr. 14, 2006 (IT) ..... MI2006A0765

(51) Int. Cl.
*B25B 1/20* (2006.01)

(52) U.S. Cl. ..... 269/37; 269/289 R; 269/900

(58) Field of Classification Search ..... 269/37, 269/21, 289 R, 291, 900, 303, 267
See application file for complete search history.

(56) References Cited

U.S. PATENT DOCUMENTS

| | | | | |
|---|---|---|---|---|
| 5,110,239 | A * | 5/1992 | Riley et al. | 409/125 |
| 5,984,293 | A * | 11/1999 | Abrahamson et al. | 269/266 |
| 6,042,095 | A * | 3/2000 | Kuchta et al. | 269/21 |
| 6,439,559 | B1 * | 8/2002 | Kinnard et al. | 269/21 |
| 7,204,481 | B2 * | 4/2007 | Sears et al. | 269/266 |
| 7,311,302 | B1 * | 12/2007 | Farlow et al. | 269/296 |
| 2007/0241006 | A1 * | 10/2007 | Meda | 206/308.1 |

FOREIGN PATENT DOCUMENTS

| | | |
|---|---|---|
| EP | 1 160 074 A | 12/2001 |
| EP | 1 366 893 A | 12/2003 |
| WO | WO 01/08876 A | 2/2001 |

* cited by examiner

*Primary Examiner* — Lee D Wilson
(74) *Attorney, Agent, or Firm* — Modiano & Associati; Albert Josif; Daniel O'Byrne

(57) ABSTRACT

An apparatus for moving and positioning objects to be laminated inside a press, comprising a tray arranged on a horizontal plane and having multiple seats with vertical axis. Each seat accommodates a pin having a protruding head and forming, with their heads, a supporting surface for the object to be positioned in the press. The pins are movable along the seat axis to pass from a raised position, in contact with the object, to a lowered position, in which they are spaced downwardly from the object. The apparatus further comprises elastic wings which cooperate with each pin and seat in order to retain the pin in the raised position, and selection elements which can engage a protruding portion of each pin for the transition of the pin from the raised position to the lowered position.

22 Claims, 9 Drawing Sheets

APPARATUS FOR MOVING AND POSITIONING OBJECTS TO BE PRESS LAMINATED

The present invention relates to an apparatus for moving and positioning objects, particularly objects such as panels for manufacturing furniture components or the like, to be laminated inside presses.

BACKGROUND OF THE INVENTION

As is known, lamination of panels, particularly panels for manufacturing furniture components, by means of a lamina of synthetic material, by veneering or the like, is generally performed by heating and causing the adhesion of the facing lamina to the panel inside a press.

In many cases, the lamina must cover one of the largest faces of the panel and the lateral faces that are adjacent to such larger face.

Because of this requirement, the panels to be laminated are generally fed to the press by arranging them on a tray, which supports the panel by means of a plurality of pins. More particularly, the panel is rested, on a substantially horizontal plane, on the tray and is supported by a plurality of pins which have a substantially vertical axis and make contact with its lower face, which constitutes one of the larger faces of the panel and lies opposite the face that is designed to be laminated together with the lateral faces.

In order to allow the lamina used for lamination to cover completely the lateral faces, the pins with which the tray is equipped generally can be arranged in two positions: a raised position, in which they make contact with the lower face of the panel, and a lowered position, in which they are spaced below the lower face of the panel, which is supported by the pins which instead are in the raised position. The pins that are completely covered by the panel are moved manually or mechanically or kept in the raised position before or after the deposition of the panel on the tray, while the pins that are designed to be covered only partially or not covered at all by the panel are moved into or kept in the lowered position. In this manner, the panel rests on the pins in the raised position with its lower face except for a region which lies proximate to the edge of the panel, so that the lamina, as a consequence of the pressure applied by the press, optionally assisted by suction applied to the lower face of the lamina, can adhere to the upper face and to the lateral faces of the panel.

A tray of this kind is disclosed in EP 1,160,074 by the same Applicant.

The tray disclosed in this patent is arranged on a substantially horizontal plane and is used to insert and remove the panels or other objects to be laminated in the press. More particularly, the tray has a plurality of seats which have a substantially vertical axis and each of which accommodates a pin provided with a head which protrudes from the upper face of the tray. Such pins define, as a whole, with their heads, a supporting surface for the lower face of the panel to be laminated. The pins can move individually on command, along the axis of the corresponding seat, in order to pass from a raised position, in which they are adapted to make contact with the panel and support it, to a lowered position, in which they are spaced downwardly from the panel. For each pin elastic means are provided which co-operate with the pin and the corresponding seat so as to retain the pin in the raised position. Such elastic means are flexible in order to allow the passage of the corresponding pin from the raised position to the lowered position or vice versa.

When it is necessary to pass from the lamination of one type of panel to another type of panel which differs in terms of dimensions and/or shape, it becomes necessary to perform the so-called "reset" of the position of the pins in the tray used previously. This resetting operation consists substantially in moving all the pins into the lowered position or raised position so as to be able to then perform a selection operation, by way of which only the pins whose head is designed to be covered completely by the new panel to be laminated are moved into or kept in the raised position.

In the European patent cited above, among the several methods for preparing the tray for positioning a different type of panel or panels, the suggestion is given to start with all the pins arranged in a position which is intermediate between the raised position and the lowered position and to act by way of selection means exclusively on the pins which are covered or will be covered completely by the panel or panels, so as to produce their transition to the raised position, in which they are kept by the action of the elastic means.

In using trays of this kind, it has been found that it is preferable to prepare the tray with the panel or panels to be fed to the press already resting on the pins. In this preferred operating condition, the transition of the pins that are completely covered by the panel or panels from the intermediate position to the raised position lifts the panel or panels. Since lifting of the pins that are completely covered by the panel or panels does not occur simultaneously but in succession by rows of pins, unwanted displacements of the panel or panels can occur with respect to the tray, penalizing the precision of positioning and possibly compromising the good outcome of the lamination operation.

For this reason, the need is felt to be able to prepare the tray by starting the operation with all the pins in the raised position and then causing the transition of the pins that are not completely covered by the panel or panels from the raised position to the lowered position.

This operation, as suggested in the above cited European patent, can be performed by acting manually or mechanically on the head of the pins to be lowered. In the case of automated action, the above cited European patent suggests the use of a bar which is moved above the tray and supports a plurality of pressers, which can be operated individually in order to act exclusively on the pins that must be lowered.

The adoption of a bar of this kind does not entail problems if the selection of the pins is performed before resting the panel or panels on the tray, but it is unquestionably a source of problems when one wishes to prepare the tray when the panel or panels is or are already rested on the tray.

SUMMARY OF THE INVENTION

The aim of the present invention is to solve the problems described above by providing an apparatus for moving and positioning objects, particularly objects such as panels for manufacturing furniture components or the like, to be laminated inside presses, which is provided with a tray for supporting the objects to be laminated and allows to prepare correctly the objects on the tray, avoiding unwanted movements of the objects after their deposition on the tray.

Within this aim, an object of the invention is to provide an apparatus which, if required, allows to perform the reset operation and the pin selection operation in a same station for positioning the objects to be laminated on the tray.

Another object of the invention is to provide an apparatus which has high reliability and precision in operation as regards the arrangement of the pins in the raised position or in the lowered position.

Still another object of the invention is to provide an apparatus which allows several operating methods for performing the transition of the pins from the raised position to the lowered position or vice versa.

This aim and these and other objects, which will become better apparent hereinafter, are achieved by an apparatus for moving and positioning objects, particularly objects such as panels for manufacturing furniture components or the like, to be laminated inside presses, comprising a tray which is arranged on a substantially horizontal plane and in which a plurality of seats are provided which have a substantially vertical axis, each seat accommodating a pin provided with a head which protrudes, with one of its ends, from the upper face of said tray, said pins defining, as a whole, with their heads, a supporting surface for the lower face of the object to be positioned in the press, said pins being movable individually on command along the axis of the corresponding seat in order to pass from a raised position, in which they are adapted to make contact with said object and support it, to a lowered position, in which they are spaced downwardly from the object, elastic means being provided for each of said pins and cooperating with each pin and the corresponding seat in order to retain the pin in said raised position, said elastic means being flexible in order to allow the transition of the corresponding pin from the raised position to the lowered position or vice versa, characterized in that it comprises selection means which can engage on command a portion of each pin which protrudes downwardly from said tray for the transition of said pin from said raised position to said lowered position.

BRIEF DESCRIPTION OF THE DRAWINGS

Further characteristics and advantages of the invention will become better apparent from the description of a preferred but not exclusive embodiment of the apparatus according to the invention, illustrated by way of non-limiting example in the accompanying drawings, wherein.

DESCRIPTION OF THE PREFERRED EMBODIMENTS

Figure 1:
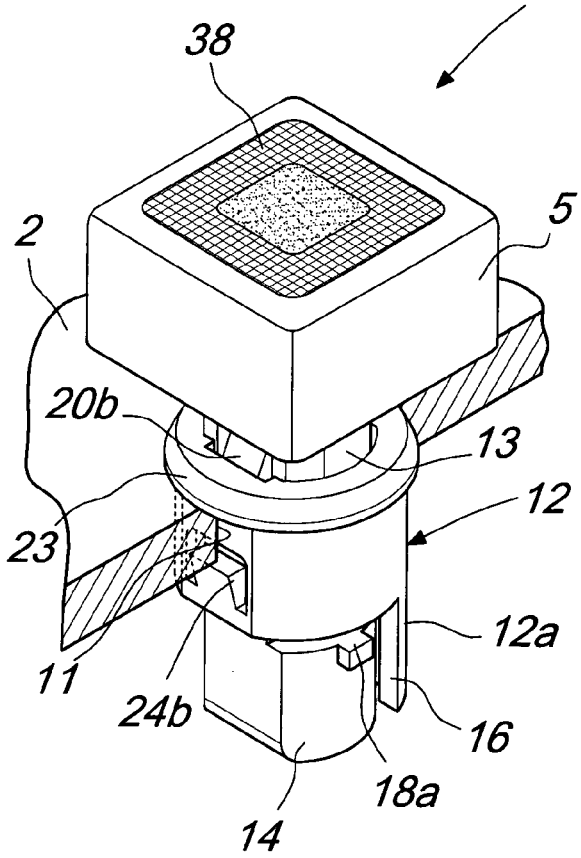
FIG. 1 is a partially sectional perspective view of a portion of the tray related to a pin.
Figure 2:
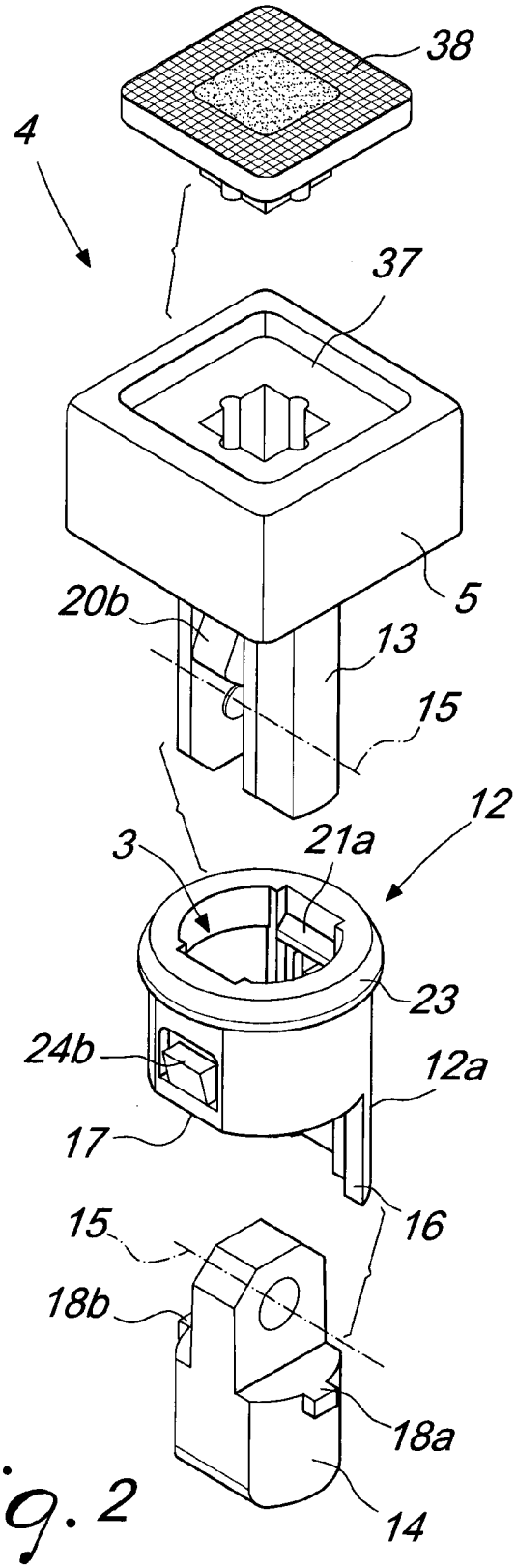
FIG. 2 is an exploded perspective view of a pin of the apparatus according to the invention and of the seat in which it is to be inserted.
Figure 3:
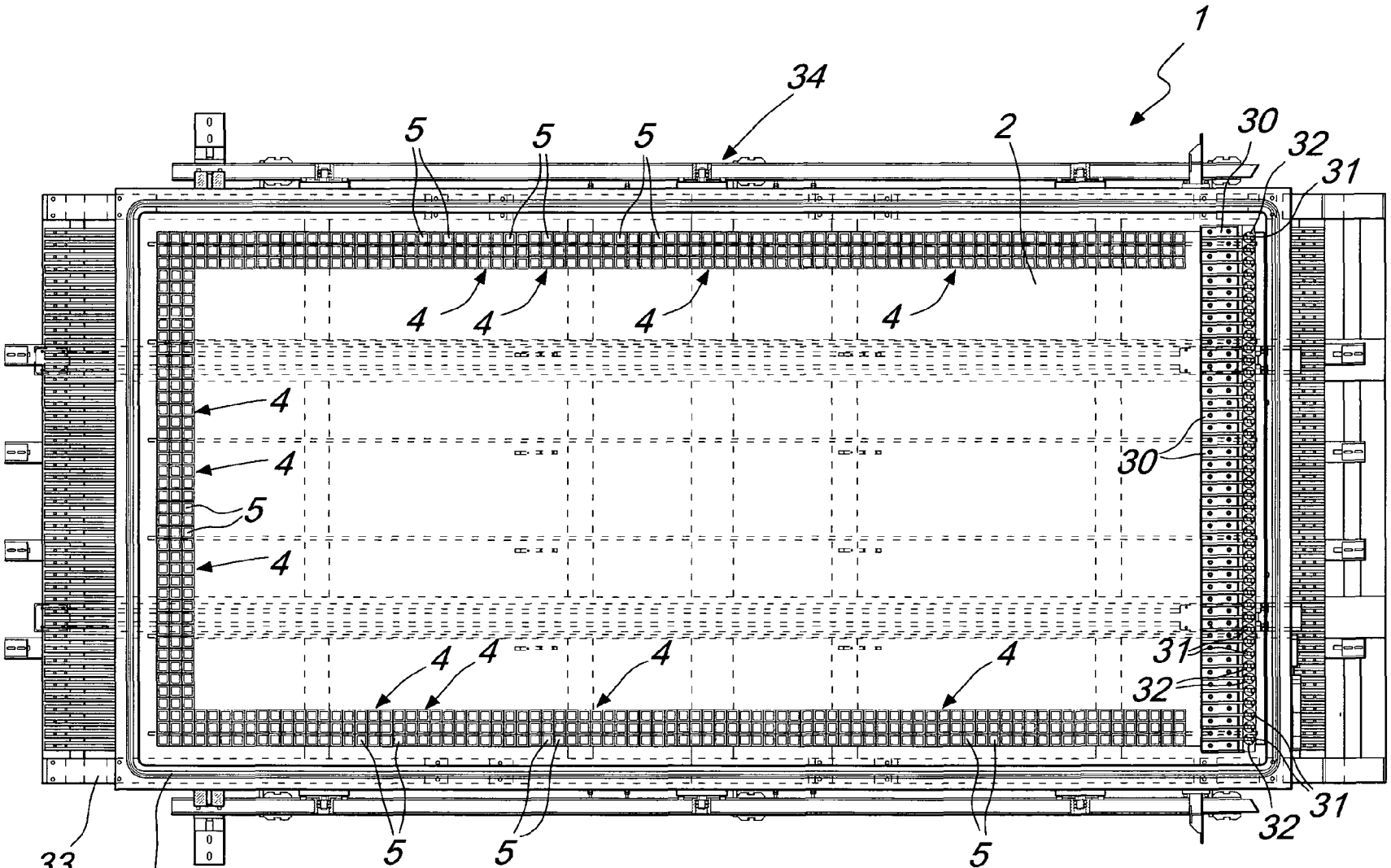
FIG. 3 is a top plan view of the apparatus according to the invention, showing only part of the pins for the sake of simplicity.
Figure 4:
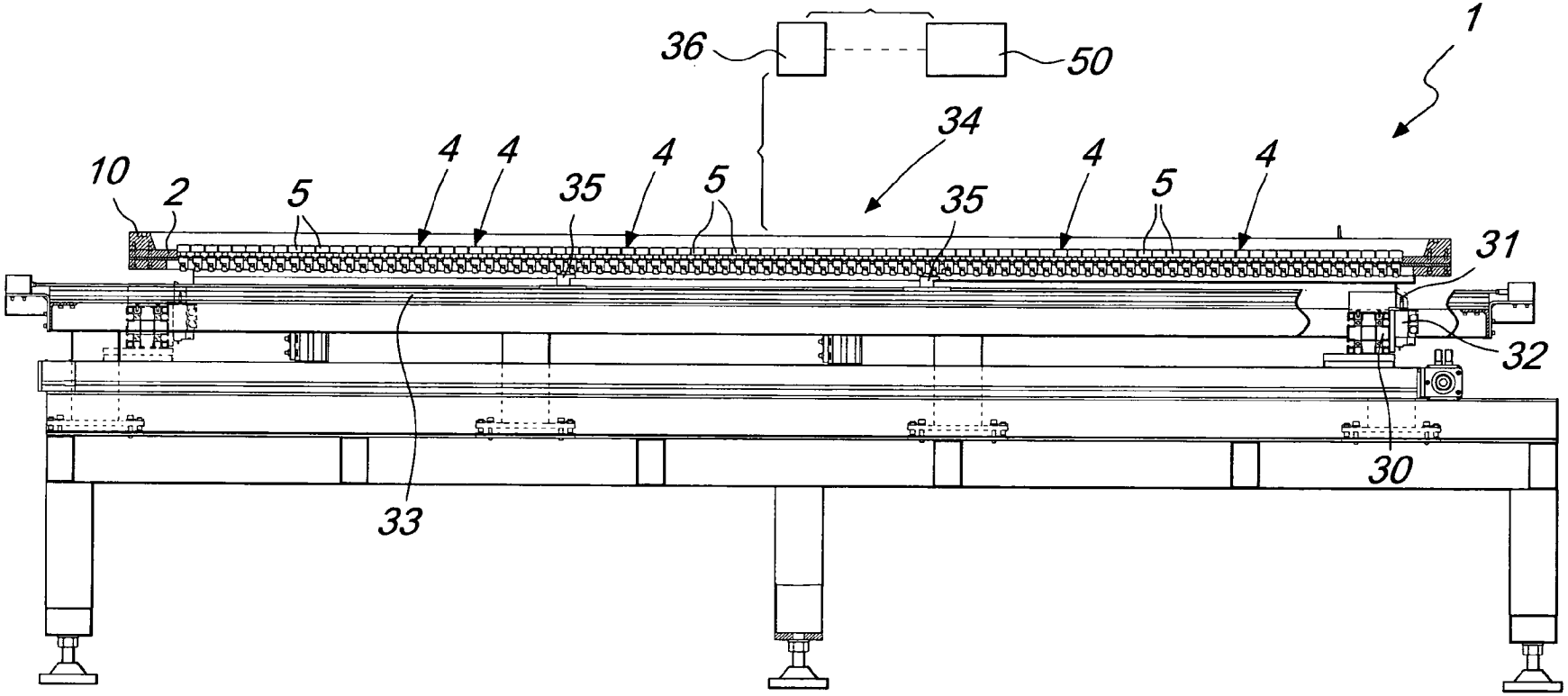
FIG. 4 is a partially sectional side elevation view, taken along a vertical plane, of the apparatus according to the invention.
Figure 5:
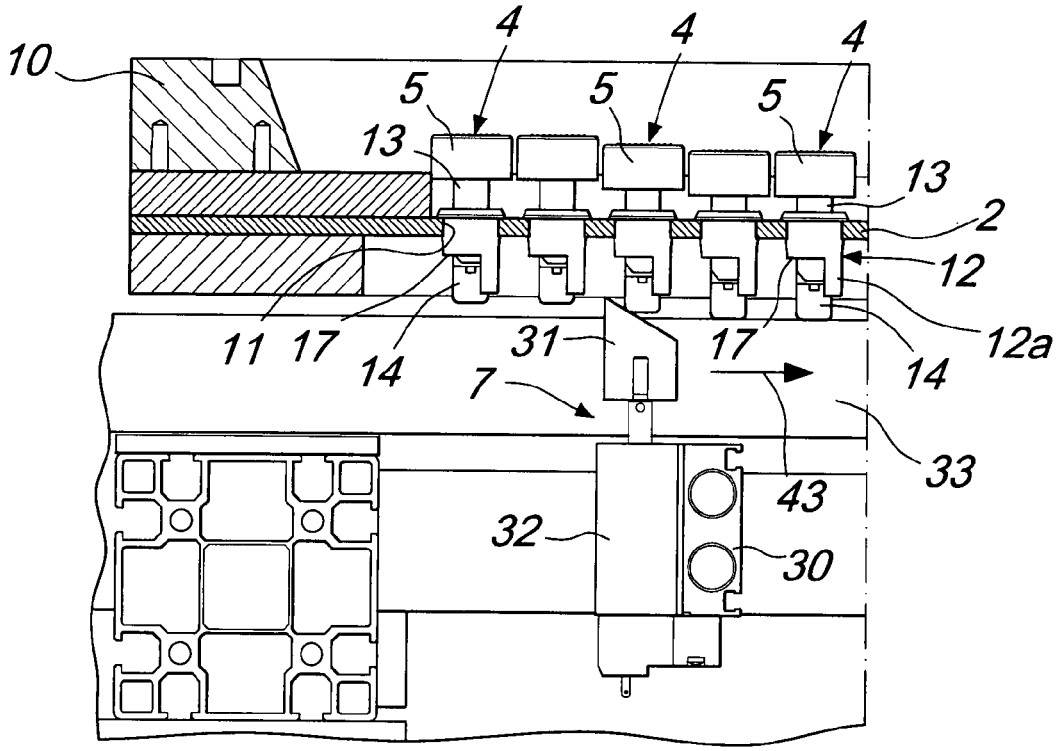
FIGS. 5 and 6 are enlarged-scale views of a portion of FIG. 4, illustrating two steps of the sequence for actuating a pin to transfer it from the lowered position to the raised position.
Figure 6:
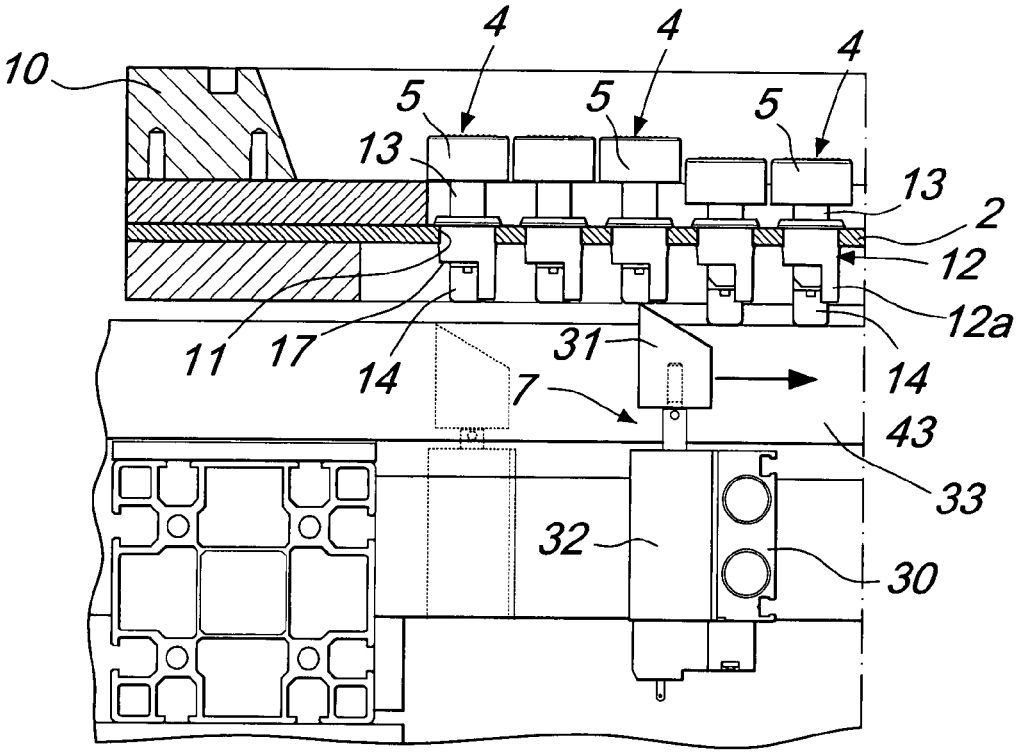
Figure 8:
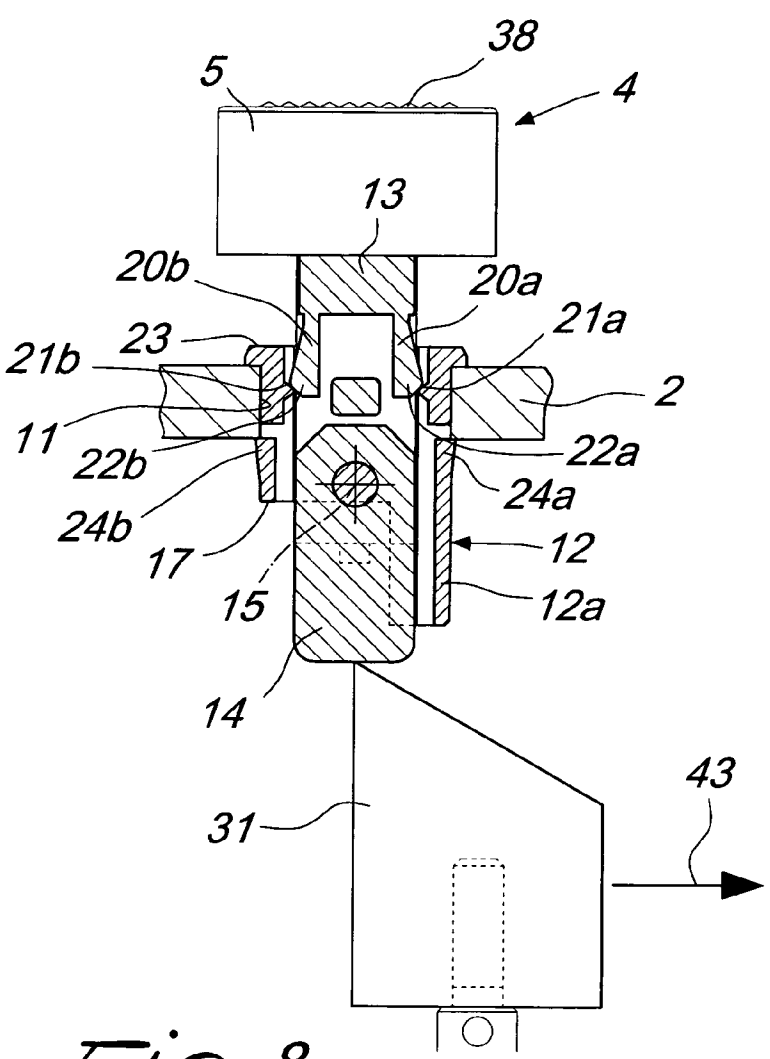
FIGS. 7 and 8 are further sectional enlarged-scale views of a detail of FIGS. 5 and 6 respectively.
Figure 7:
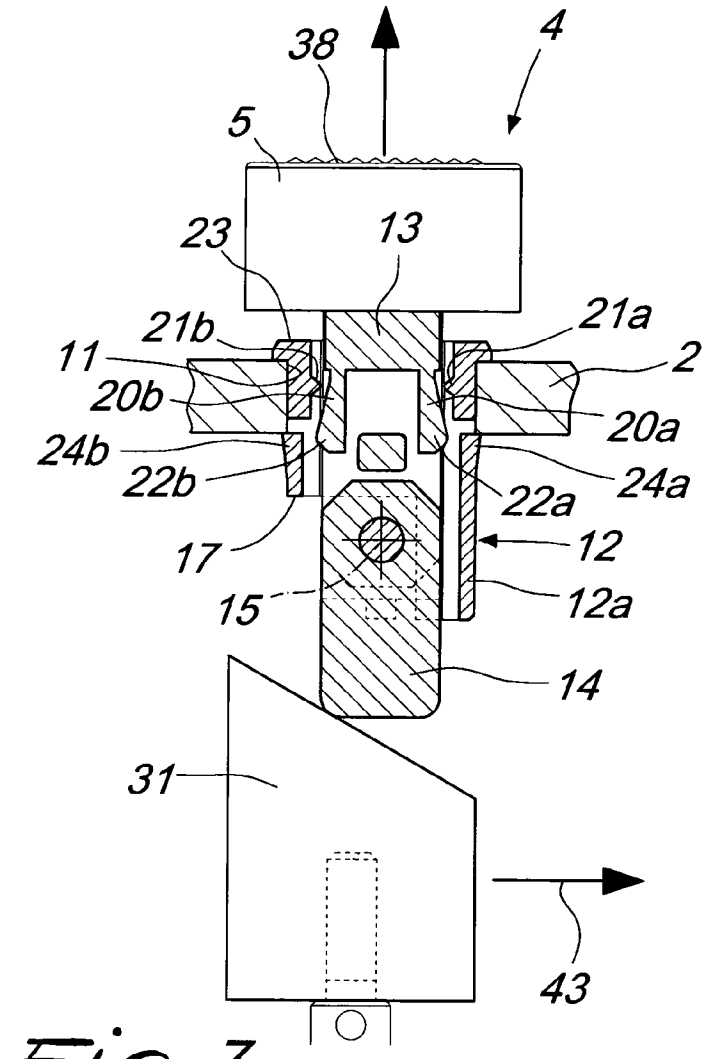
Figure 9:
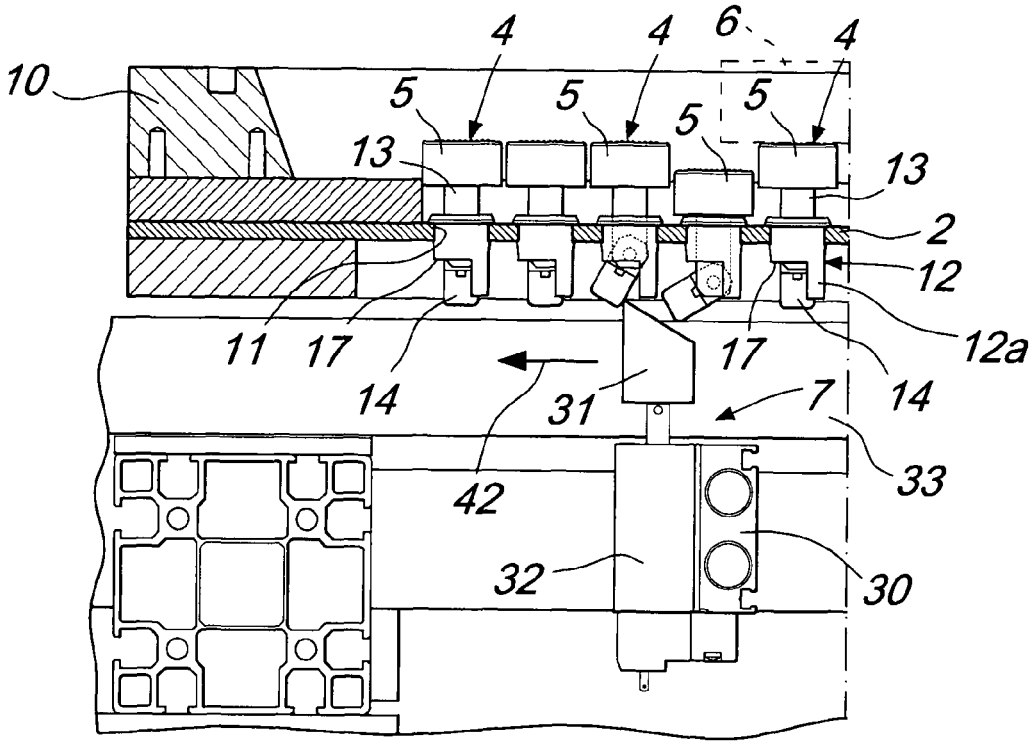
FIGS. 9 and 10 are enlarged-scale views of a portion of FIG. 4, illustrating two steps of the sequence for actuating a pin to transfer it from the raised position to the lowered position by way of the selection means.
Figure 10:
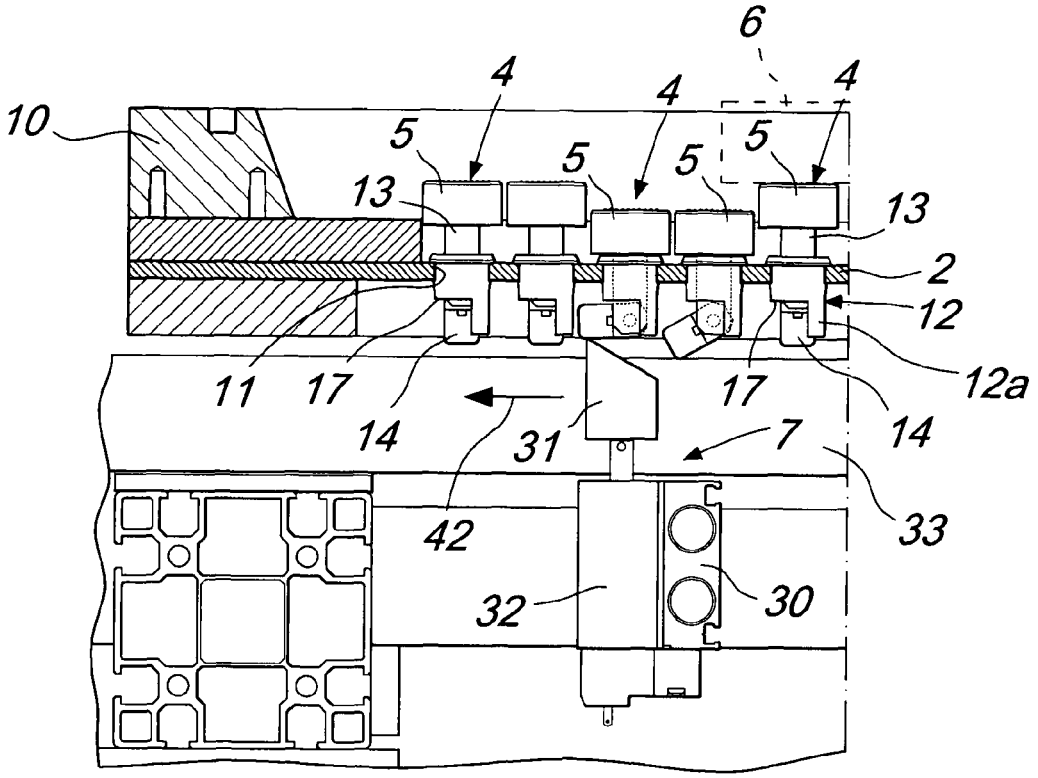
Figure 12:
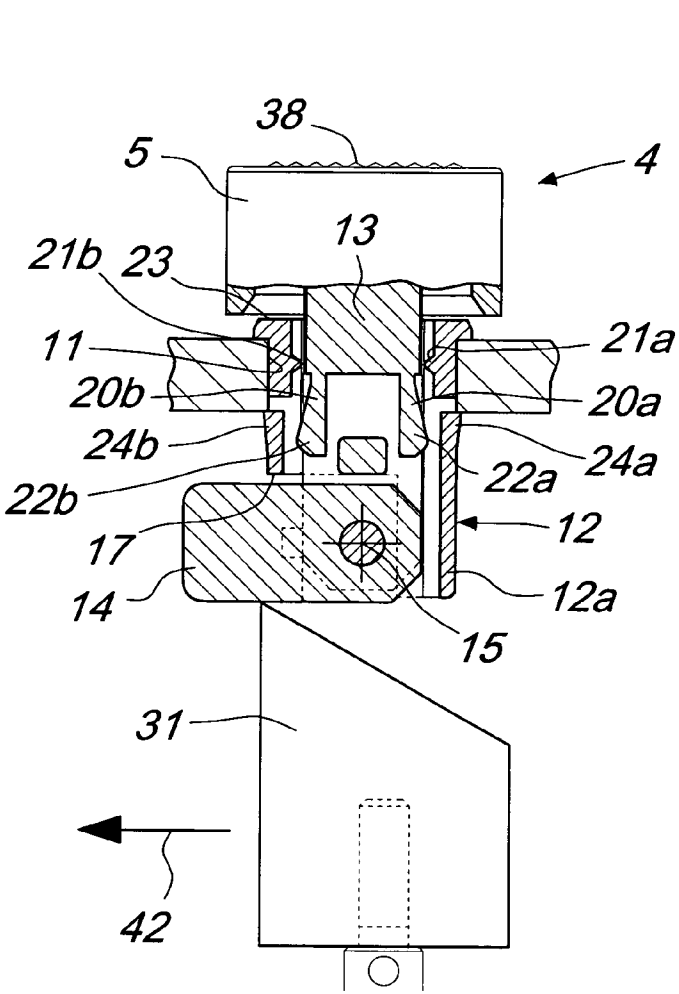
FIGS. 11 and 12 are further sectional enlarged-scale views of a detail of FIGS. 9 and 10 respectively.
Figure 11:
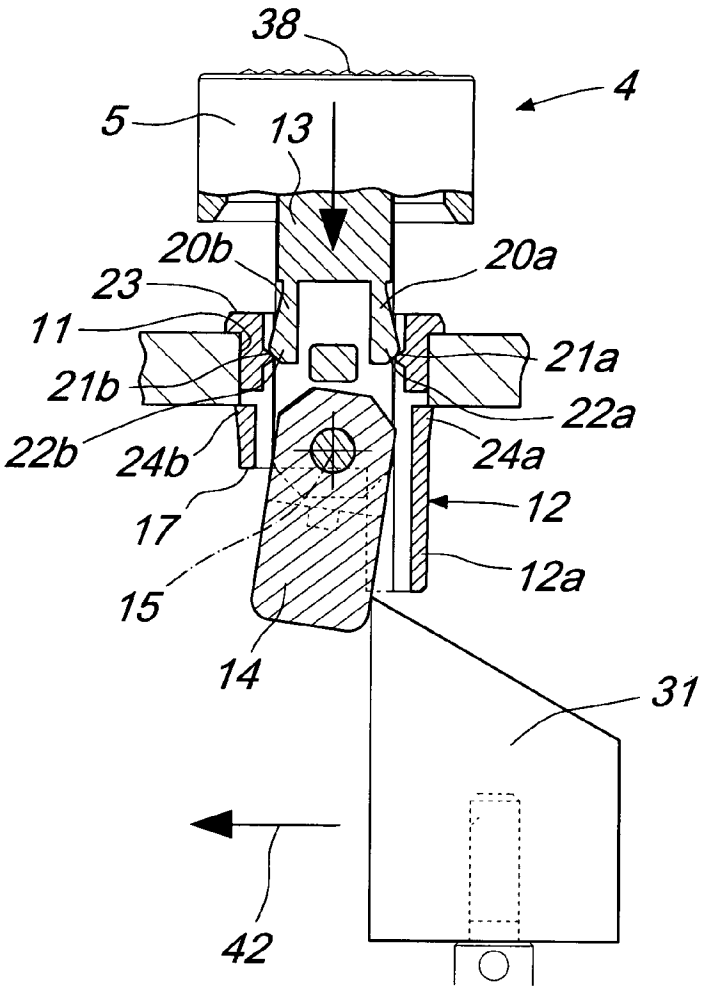
Figure 13:
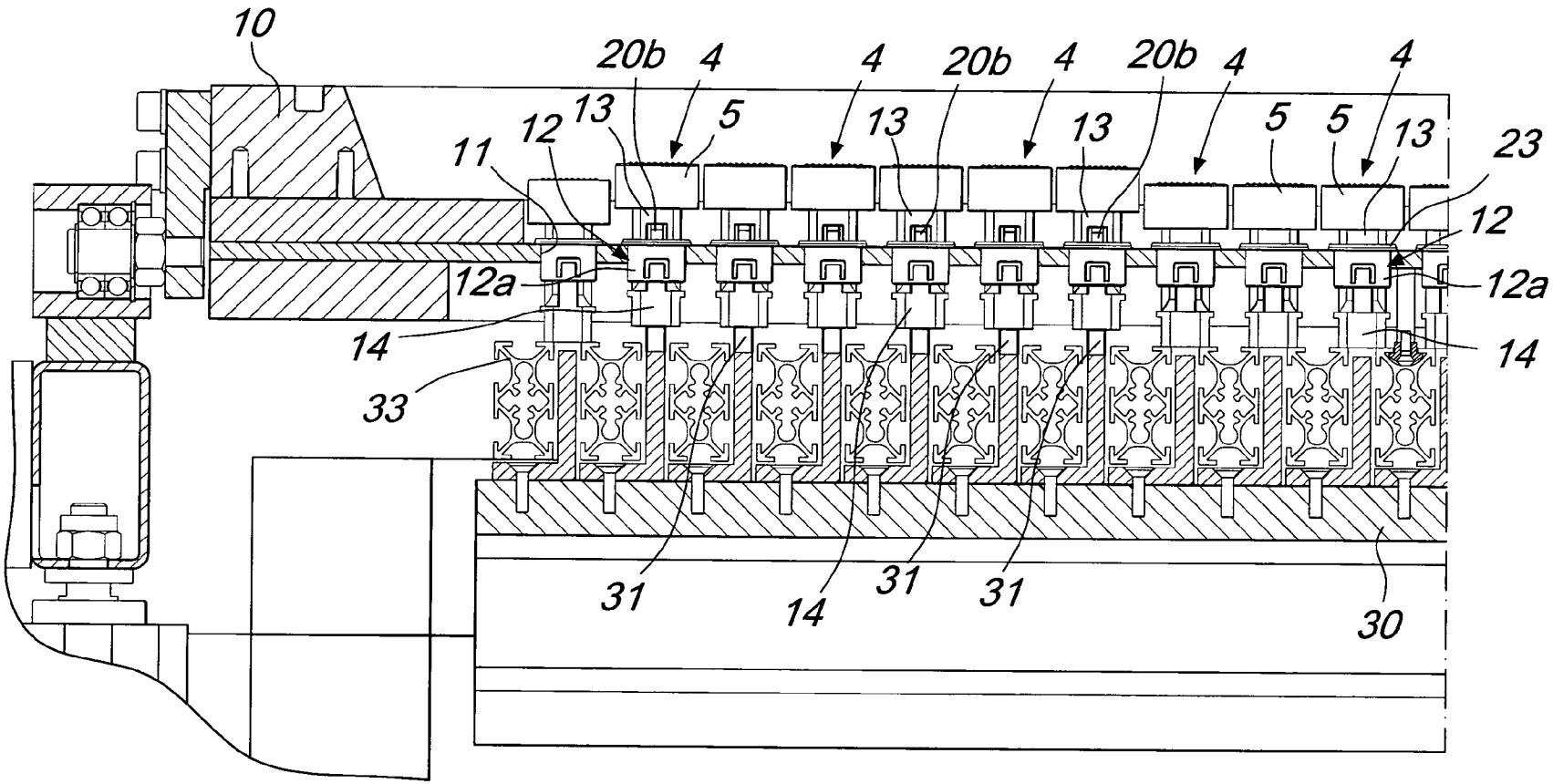
FIG. 13 is a sectional view of a detail of the apparatus according to the invention, taken along a vertical plane which is arranged at right angles to the plane along which the sectional view of FIG. 4 is taken.

With reference to the figures, the apparatus according to the invention, generally designated by the reference numeral 1, comprises a tray 2, which is arranged on a substantially horizontal plane and in which a plurality of seats 3 are provided which have a substantially vertical axis, each seat accommodating a pin 4, provided with a head 5 which protrudes from the upper face of the tray 2.

Preferably, the pins 4 are aligned along parallel rows and are uniformly mutually spaced along the various rows so as to also have an alignment among the pins that belong to the various rows of pins.

Figure 14:
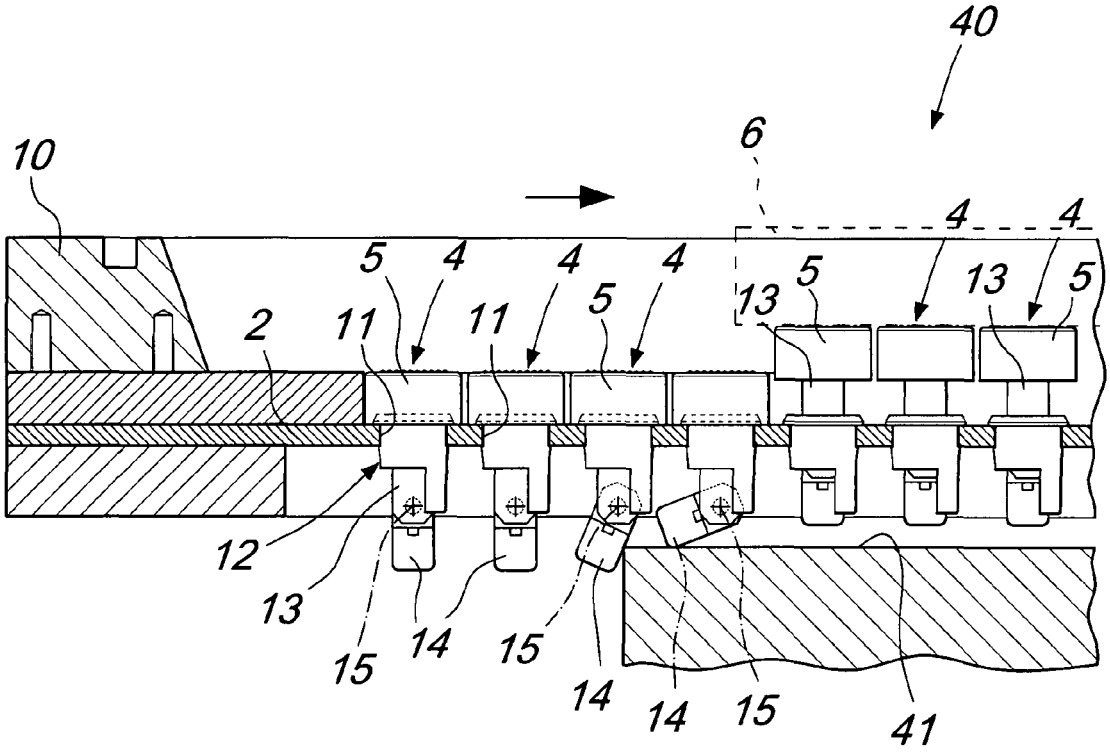
FIGS. 14 and 15 are views of the sequence for the insertion of the tray within the press, with the tray shown in cross-section along a vertical plane.
Figure 15:
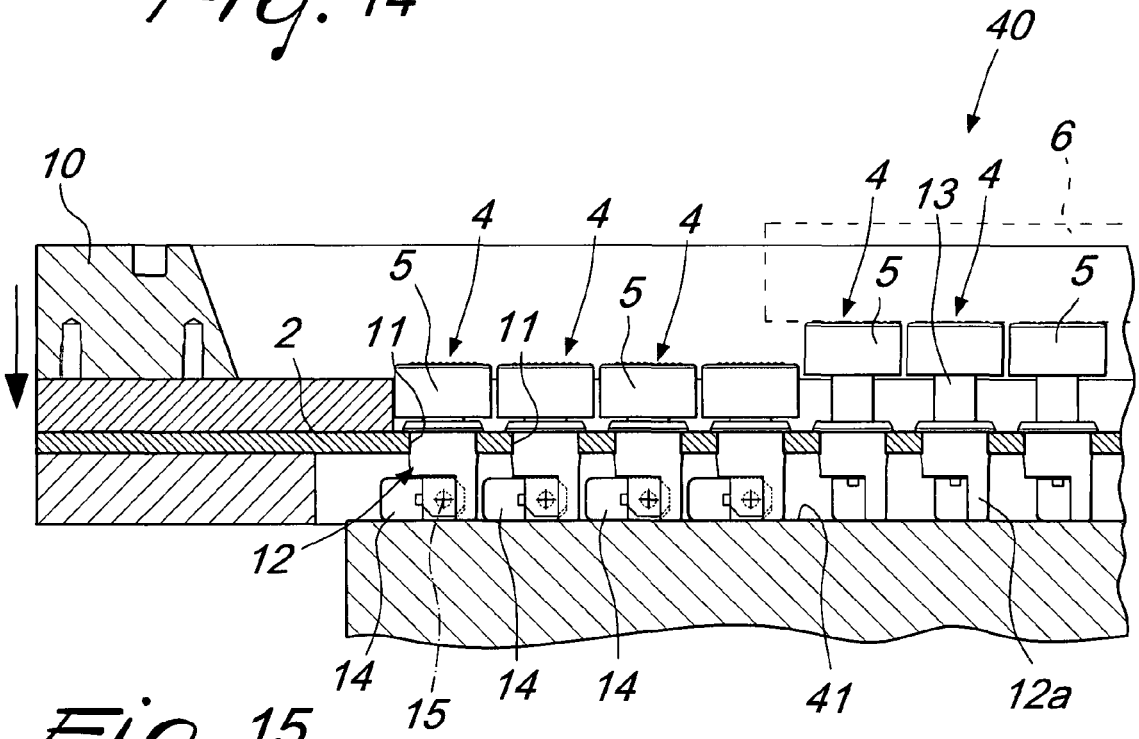

The pins 4 define, as a whole, with their heads 5, a substantially horizontal supporting surface for the lower face of an object 6, which is constituted in particular by a panel, to be supported and fed to a conventional press 40, which is shown only partially in FIGS. 14 and 15. The pins 4 can move individually on command along the axis of the corresponding seat 3 in order to pass from a raised position, in which they are adapted to make contact with the object 6 and support it, to a lowered position, in which they are spaced downwardly from the object 6, as will become better apparent hereinafter.

The apparatus comprises, for each of the pins 4, elastic means which cooperate with each pin 4 and the corresponding seat 3 in order to retain the pin 4 in the raised position. Such elastic means are flexible in order to allow the transition of the corresponding pin 4 from the raised position to the lowered position or vice versa.

According to the invention, the apparatus comprises selection means 7, which can engage on command a portion of each pin 4 which protrudes downwardly from the tray 2 in order to produce its transition from the raised position to the lowered position.

More particularly, the apparatus according to the invention comprises a tray 2 which is arranged on a substantially horizontal plane and preferably has, proximate to its peripheral region, a raised rim 10.

A plurality of through holes 11 with a vertical axis are defined in the tray 2, and bushes 12 are locked coaxially therein; a seat 3 is defined inside each of said bushes.

Each pin 4 has a head 5, which protrudes upwardly from the seat 3, a stem 13, which has a smaller diameter than the head 5 and is accommodated so that it can slide axially in the corresponding seat 3, and a foot 14, which is pivoted to the stem 13 about a horizontal pivoting axis 15 and can rotate about the pivoting axis 15 with respect to the stem 13 in order to vary the useful axial length of the pin 4 from an extended condition of the pin 4, in which the foot 14 is aligned with the stem 13, to a shortened condition of the pin 4, in which the foot 14 is turned, preferably at right angles, laterally with respect to the stem 13.

The foot 14, with the pin 4 in the raised position and in the extended condition, protrudes downwardly, with its lower end, from the lower base of the seat 3. The selection means 7 can engage on command the lower end of the foot 14, which in this condition protrudes downwardly from the lower base of the seat 3, in order to produce the rotation of the foot 14 about the pivoting axis 15 with respect to the stem 13, producing the transition of the pin 4 from the extended condition to the shortened condition and simultaneously producing the transition of the pin 4 from the raised position to the lowered position, as described in greater detail hereinafter.

The bush 12 protrudes with a portion 12*a* from the lower face of the tray 2, and the portion 12*a* has a lateral recess 16, starting from its lower end, which allows the rotation of the foot 14 about the pivoting axis 15, starting from the extended condition of the pin 4 in the raised position, in a single direction of rotation. The recess 16 further forms a lateral support 17 for the foot 14, which is spaced downwardly with respect to the pivoting axis 15 when the pin 4 is in the raised position and in the extended condition, during the rotation of the foot 14 about the pivoting axis 15 in order to pass from the extended condition to the shortened condition of the pin 4, so as to cause simultaneously the transition of the pin 4 from the raised position to the lowered position.

The portion 12*a* of the bush 12 which is not occupied by the recess 16 contrasts the rotation of the foot 14 about the pivoting axis 15 in the opposite direction with respect to the direction of rotation allowed by the recess 16 when the pin 4 is in the extended condition and at least in the raised position or in a position which is intermediate between the raised position and the lowered position.

Conveniently, stop means for stopping the lifting of the pin 4 with respect to the tray 2 in order to avoid the upward extraction of the pin 4 from the seat 3 are provided.

Such stop means comprise at least an axial shoulder 18*a*, 18*b*, which is defined by a lateral protrusion of the foot 14, which can engage a stop element formed by the bush 12 which limits the possibility of upward movement of the pin 4 with respect to the tray 2 to a position which is slightly further raised with respect to the above cited raised position. In this further raised position, the lower end of the foot 14, in the extended condition of the pin 4, is substantially flush with the lower end of the portion 12*a* of the bush 12 which is not affected by the lateral recess 16 (i.e. where the recess 16 does not extend).

In the illustrated embodiment two protrusions are provided on the lateral surface of the foot 14 which form two shoulders 18*a*, 18*b* in two mutually diametrically opposite regions of the foot 14.

The elastic means cited above comprise at least a wing 20*a*, 20*b*, which is associated with the stem 13 and can engage at least an abutment 21*a*, 21*b* provided on the side walls of the corresponding seat 3.

Preferably, the head 5 and the stem 13 are formed monolithically, preferably with molded synthetic material, and the wing 20*a*, 20*b* is constituted by a portion of the stem 13 which is elastically flexible toward or away from the axis of the stem 13 in order to move beyond the abutment 21*a*, 21*b* in the transition of the pin 4 from the raised position to the lowered position or vice versa.

The wing 20*a*, 20*b* is connected to the remaining part of the stem 13 proximate to its upper end and has, proximate to its lower end, a tooth 22*a*, 22*b* which at rest, i.e., when the wing 20*a*, 20*b* is not affected by forces, protrudes from the lateral surface of the stem 13.

The abutment 21*a*, 21*b* is formed by a narrower portion of the seat 3 at a portion which faces the wing 20*a*, 20*b*. Such narrower portion is constituted by a tooth provided on the lateral surface of the seat 3.

Preferably, instead of a single wing, there are two wings 20*a*, 20*b*, which are arranged in two mutually diametrically opposite regions of the stem 13 and can flex toward or away from each other.

Correspondingly, two abutments 21*a*, 21*b* are provided within the seat 3, are arranged in two diametrically mutually opposite regions on the lateral surface of the seat 3 and are designed to be engaged by the teeth 22*a*, 22*b* of the wings 20*a*, 20*b*.

The seat 3 and the stem 13 have a substantially cylindrical shape, preferably with a non-circular cross-section, in order to avoid the possibility of a rotation of the pins 4 about the corresponding axis with respect to the seat 3.

The bush 12 also is preferably made of molded synthetic material and has, proximate to its upper end, a protruding rim 23, which is designed to be rested against the upper face of the tray 2 when the bush 12 is inserted within the corresponding hole 11.

Two elastically flexible wings 24*a*, 24*b* are provided on the lateral surface of the bush 12, in a region which is spaced downwardly from the rim 23, and at rest, i.e., in the condition in which they are not affected by forces, protrude from the lateral surface of the bush 12 and can flex elastically toward the axis of the bush 12 in order to pass through the hole 11 and engage with a snap action, as a consequence of their elastic reaction, the lower face of the tray 2, thus locking axially the bush 12 in the corresponding hole 11 of the tray 2.

Preferably, the selection means 7 comprise a horizontal supporting bar 30, which is parallel to the rows of pins 4 and can be positioned in each instance below a row of pins 4 and is provided with a lower actuation element 31 for each pin 4 of a row of pins. The actuation element 31 can be activated in order to interfere with the foot 14 of the overlying pin 4, which during selection is in the extended condition and in the raised position, so as to produce its transition from the extended condition to the shortened condition with simultaneous transition from the raised position to the lowered position.

Moreover, the apparatus according to the invention comprises reset means, which can engage the pins 4 in the lowered position in order to produce their transition to the raised position. Said reset means can comprise, in a manner similar to the selection means 7, a supporting bar which can be positioned in each instance below a row of pins 4 and is provided with a lower actuation element for each pin 4 of the row. Each lower actuation element is adapted to interfere with the foot 14 of the overlying pin 4, which is arranged in a position which is intermediate between the lowered position and the raised position and in the extended condition of the pin, in order to move the pin 4 to the raised position.

As an alternative, the reset operation, i.e., the transition of any pins 4 that are in the lowered position to the raised position, can be performed, as disclosed in the above cited European patent, by lowering the tray 2 against a horizontal surface, constituted for example by the lower surface of the press or a surface which is external to said press, so that the pins 4 in the lowered position and in the extended condition, by resting against said horizontal surface with the lower end of their foot 14, are pushed upwardly, reaching the raised position.

Also as an alternative, the reset operation can be performed by means of the method and the device disclosed in EP-1,366,893, by sliding the tray on a surface on which there is a protrusion which, as a consequence of said sliding, produces the gradual lifting of the pins in the raised position.

Preferably, the reset means are constituted by the selection means 7 themselves, which when actuated appropriately can also actuate the transition of the pins 4 from the lowered position to the raised position.

More particularly, the supporting bar 30 can perform a translational motion with respect to the tray 2 along a horizontal direction, at right angles to the rows of pins 4, in a translational direction 42 in order to actuate, by way of the activated lower actuation elements 31, the transition of the pins 4 from the raised position to the lowered position and in the opposite translational direction 43 in order to actuate, by way of the activated lower actuation elements 31, the transition of the pins 4 from the lowered position to the raised position.

In each of the lower actuation elements 31, the side designed to make contact with the foot 14 of the pins 4 during the translational motion of the supporting bar 30 in said translational direction 42 is shaped like a vertical plane, so as to interfere with the foot 14 and produce its rotation with respect to the stem 13 about the pivoting axis 15, and the opposite side, designed to make contact with the foot 14 of the pins 4 during the translational motion of the supporting bar 30 in the opposite translational direction 43, is shaped so as to form a plane which is inclined with respect to the vertical so as to produce the gradual lifting of the pin 4.

Each lower actuation element 31 can be moved from a deactivation position, in which it does not interfere with the foot 14 of the pins 4, to an activation position, in which it is in a position which is raised with respect to the deactivation position, so as to interfere with the foot 14 of a pin 4 in order to produce the rotation of the foot 14 about the pivoting axis 15 or the lifting of the pin 4 when the bar 30 is moved with respect to the tray 2 in the translational direction 42 or in the opposite translational direction 43.

The transition of the lower actuation element 31 from the deactivation position to the activation position and vice versa can be achieved by means of a pneumatic actuator 32, an electromagnetic actuator, or other known types of actuator, mounted on the supporting bar 30.

The selection means 7 are preferably arranged on a horizontal bed 33, which is arranged in a positioning station 34 preferably located laterally with respect to the press 40 to be served. The bed 33 supports, so that it can slide along the above cited translational direction, the supporting bar 30, which is arranged below the bed 33, and is provided preferably with means 35 for engaging the tray 2 during the reset operation and the selection operation. Appropriate slots for the passage of the lower actuation elements 31 are provided in the bed 33.

Advantageously, the apparatus according to the invention can comprise sensing means 36 for sensing the contour of the object 6 arranged on the pins 4 and such sensing means 36 are functionally connected to the actuators 32 of the selection means 7, so as to produce the actuation of the actuators 32 as a function of the profile of the sensed object 6, as will become better apparent hereinafter.

The sensing means 36 can be constituted by a proximity sensor, a photocell, a television camera or other adapted known type of sensing means.

The actuators of the selection means 7 can also be connected functionally to an actuation element 50 of the programmable electronic type, in which the contour of the object 6 to be supported by means of the pins 4 is stored and which is adapted to actuate individually the pneumatic actuators 32 of the selection means 7 as a function of the contour of the object 6 to be arranged on the pins 4, keeping the pins 4 that are designed to be covered completely by the object 6 in the raised position and moving the pins 4 that are instead adapted to be covered only partially or not at all by the object 6 into the lowered position.

For the sake of completeness in description, it should be noted that a seat 37 is formed in the head 5 of the pin 4 and accommodates a contact pad 38, which is preferably made of elastically deformable material, in order to achieve a soft support for the object 6 on the head 5, thus avoiding accidental movements of the object 6.

Operation of the apparatus according to the invention is as follows.

The tray 2 which must be loaded with the objects 6 to be laminated inside the press 40 is arranged in the positioning station 34 above the bed 33, to which it is coupled by way of the engagement means 35.

It should be noted that the tray 2, before being coupled to the bed 33, is lowered onto the bed 33 so that the pins 4 that are in the lowered position make contact, with the lower end of their foot 14, with the upper face of the bed 33 and are moved into a position which is intermediate between the lowered position and the raised position. In this intermediate position, the teeth 22*a*, 22*b* of the wings 20*a*, 20*b* are arranged below the abutments 21*a*, 21*b*.

The supporting bar 30 is moved in the opposite translational direction 43 with all the lower actuation elements 31 in the activation position, so as to produce the transition to the raised position of any pins 4 which, as a consequence of a previous use of the tray 2, might be in the lowered position, as shown in FIGS. 5, 6, 7 and 8. In this manner, all the pins 4 are in the raised position with the teeth 22*a*, 22*b* of their wings 20*a*, 20*b* arranged above the abutments 21*a*, 21*b*.

The object or objects 6 to be laminated inside the press 40 is or are then rested on the head 5 of the pins 4.

The contour of the objects 6 is detected by the sensing means 36, which either directly or by way of the actuation element of the programmable electronic type, during the translational motion of the supporting bar 30 in the translational direction 42, move into the activation position the lower actuation elements 31 just before they pass below the pins 4 which are covered only partially or not at all by the object or objects 6.

The lower actuation elements 31 moved into the activation position make contact with the lower end of the foot 14 of these pins 4, producing their rotation about the pivoting axis 15 with respect to the stem 13 and thus actuating the transition of the pins 4 from the extended condition to the shortened condition. During this rotation, the foot 14 rests against the lateral support 17, also causing the transition of the pins 4 from the raised position to the lowered position, i.e., moving the teeth 22*a*, 22*b* of the wings 20*a*, 20*b* below the abutments 21*a*, 21*b*, as shown in FIGS. 9, 10, 11 and 12.

Since the pins 4 that are not covered or are covered only partially by the object or objects 6 to be laminated are moved into the lowered position, the object or objects 6 is or are not moved during this operation and therefore a change in its or their arrangement on the tray 2 is safely excluded.

Moreover, since the selection means 7 are arranged below the tray 2, problems of interference of said selection means 7 with the objects 6 loaded onto the tray 2 are avoided.

At this point, the tray 2 is transferred to the lower surface 41 of the press 40.

During the transfer, the pins 4 moved into the lowered position can move further downwardly by gravity until their head 5 abuts against the upper end of the bush 12 and their foot 14 aligns itself again, again by gravity, with the stem 13, while the pins 4 that are in the raised position are kept in said position by the engagement of the wings 20*a*, 20*b* with the abutments 21*a*, 21*b*.

It should be noted that the tray 2 is inserted in the press 40 by producing the translational motion of the tray 2 to such a height that the foot 14 of the pins 4 in the lowered position makes contact with the lower surface 41 of the press 40, which produces a rotation of the foot 14 about the pivoting axis 15 of the pins 4 which are in the lowered position, i.e., producing their transition from the extended condition of the pin 4 to the shortened condition of the pin 4, as shown in FIG. 14. Once the insertion of the tray 2 in the press 40 has been completed, the lower surface 41 of the press 40 constitutes a supporting surface for the feet 14 of the pins 4 both in the extended condition and in the shortened condition, depending on whether the pin 4 is in the raised position or in the lowered position.

In this manner, the pins 4 in the raised position support the object or objects 6 to be laminated, while the pins 4 in the lowered position are spaced downwardly with respect to the object or objects 6.

The tray 2 is then lowered completely onto the lower surface 41 of the press 40 until the lower end of the bushes 12 rests on the lower surface 41 of the press 40, as shown in FIG. 15. This lowering produces a slight rise of the pins 4 that are in the raised position. It should be noted that in this manner the tray 2 is not affected by the pressure applied to the object or objects 6 during the subsequent lamination operation.

At this point, the press 40 is closed and the object or objects 6 deposited on the tray 2 is or are laminated.

Once the lamination operation has been completed, the press 40 is opened and the tray 2 is extracted in order to move away the laminated object or objects 6, which is or are unloaded from the tray 2.

If it is necessary to load onto the tray 2 objects 6 which are identical to those that have just been laminated, the new objects 6 can be rested on the pins 4 in the raised position, or if it is necessary to load objects 6 which are different from those that have just been unloaded the tray 2 is repositioned above the bed 33 in the positioning station 34 and the operating cycle resumes as already described.

The term "substantially" as herein used is intended to mean that the features to which it refers have the characteristics such features actually define, but for the shape or position tolerances which are known by the skilled in the art to be usual in the pertinent technical field.

In practice it has been found that the apparatus according to the invention fully achieves the intended aim, since it allows to prepare correctly the panels or more generally the objects on the tray to be inserted in the press, avoiding movements of the objects after their positioning and avoiding problems of interference between the selection means and the objects deposited on the tray.

Another advantage of the apparatus according to the invention, although the methods described above are preferred, is that it allows other methods of selecting the pins and resetting the pins, such as for example the methods disclosed in EP-1,160,074 or in patent application EP-1,366,893 cited above.

The apparatus thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2006A000765 from which this application claims priority are incorporated herein by reference.

What is claimed is:

1. An apparatus for moving and positioning objects to be laminated inside a press, comprising:

a tray which is arranged on a substantially horizontal plane and in which multiple seats are provided which have a substantially vertical axis;

a plurality of pins, each of which is accommodated in a respective said seat and is provided with a head which protrudes, with an end thereof, from an upper face of said tray;

a supporting surface for a lower face of an object to be positioned in the press formed by the heads of said pins, said pins being actuatable to move individually along the axis of the corresponding seat in order to pass from a raised position, in which the pins make contact with and support the object, to a lowered position, in which the pins are spaced downwardly from the object;

elastic means being provided for each of said pins and cooperating with each corresponding pin and seat in order to retain said corresponding pin in said raised position, said elastic means being flexible in order to allow transition of said pin from the raised position to the lowered position and vice versa; and selection means which are actuatable by being movable in a first translational direction to engage with a portion of each said pin which protrudes downwardly from said tray for actuating transition of said pin from said raised position to said lowered position, said selection means being further actuatable by being movable in a second translational direction opposite to said first translational direction to engage with said portion of said pin which protrudes downwardly from said tray for actuating transition of said pin from said lowered position to said raised position, said selection means being configured such that all of said plurality of pins are moved into said raised position when said selection means are moved in said second translational direction, and said selection means being configured such that only selected pins of said plurality of pins are moved into said lowered position from said raised position when said selection means are moved in said first translational direction.

2. The apparatus of claim 1, wherein each of said pins comprises: a head which protrudes upwardly from the corresponding seat, a stem which has a reduced diameter with respect to said head and is accommodated so as to be slideable along the axis of the corresponding seat, and a foot of the pin which is pivoted to the stem of the pin about a horizontal pivoting axis and is rotatable about said pivoting axis with respect to said stem of the pin, in order to vary a useful axial length of the pin, from an extended condition of the pin, in which the foot of the pin is aligned with the stem of the pin, to a shortened condition of the pin, in which the foot of the pin is rotated laterally to the stem of the pin, and vice versa.

3. The apparatus of claim 2, wherein said foot of the pin, in the extended condition of the pin, with the pin in the raised position, is located so as to protrude downwardly, with a lower end thereof, from a lower base of said seat; said selection means being actuatable to engage with said lower end of the foot of the pin which protrudes downwardly from the lower base of said seat in order to produce transition of said foot of the pin from said extended condition of the pin to said shortened condition of the pin upon rotation thereof about said pivoting axis with respect to the stem of the pin, and wherein said foot of the pin is adapted to interfere during said rotation thereof with said seat, for actuating the transition of the pin from the raised position to the lowered position.

4. The apparatus of claim 2, comprising bushes, each of which having formed therein a said seat and being inserted in a through hole which has a substantially vertical axis and is formed in said tray, each said bush further protruding with a portion thereof below said tray, and wherein said portion of each bush having a lateral recess, starting from its lower end, which is adapted to allow rotation of said foot of the pin about said pivoting axis, starting from the extended condition of the pin in said raised position, in a single direction of rotation, and wherein said recess further forms a lateral support for the foot of the pin, which is spaced downwardly from said pivoting axis of the foot of the pin in the raised position and in the extended condition of the pin, during the rotation of the foot of the pin about said pivoting axis in the transition from the extended condition of the pin to the shortened condition of the pin, in order to produce the transition of the pin from the raised position to the lowered position.

5. An apparatus for moving and positioning objects to be laminated inside a press, comprising: a tray which is arranged on a substantially horizontal plane and in which multiple seats are provided which have a substantially vertical axis; a plurality of pins, each of which is accommodated in a respective said seat and is provided with a head which protrudes, with an end thereof, from an upper face of said tray; a supporting surface for a lower face of an object to be positioned in the press formed by the heads of said pins, said pins actuatable to move individually along the axis of the corresponding seat in order to pass from a raised position, in which the pins make contact with and support the object, to a lowered position, in which the pins are spaced downwardly from the object; elastic means being provided for each of said pins and cooperating with each corresponding pin and seat in order to retain said corresponding pin in said raised position, said elastic means being flexible in order to allow transition of said pin from the raised position to lowered position and vice versa; and selection means which are actuatable to engage with a portion of each said pin which protrudes downwardly from said tray for actuating transition of said pin from said raised position to said lowered position;

each of said pins comprising: a head which protrudes upwardly from the corresponding seat, a stem which has a reduced diameter with respect to said head and is accommodated so as to be slideable along the axis of the corresponding seat, and a foot of the pin which is pivoted to the stem of the pin about a horizontal pivoting axis and is rotatable about said pivoting axis with respect said stem of the pin, in order to vary a useful axial length of the pin, from an extended condition of the pin, in which the foot of the pin is aligned with the stem of the pin, to a shortened condition of the pin, in which the foot of the pin is rotated laterally to the stem of the pin, and vice versa;

said foot of the pin, in the extended condition of the pin, with the pin in the raised position, being located so as to protrude downwardly, with a lower end thereof, from a lower base of said seat; said selection means being actuatable to engage with said lower end of the foot of the pin which protrudes downwardly from the lower base of said seat in order to produce transition of said foot of the pin from said extended condition of the in to said shortened condition of the pin upon rotation thereof about said pivoting axis with respect to the stem of the pin, and said foot of the pin being adapted to interfere during said rotation thereof with said seat, for actuating the transition of the pin from the raised position to the lowered position;

the apparatus comprising bushes, each of which having formed therein a said seat and being inserted in a through hole which has a substantially vertical axis and is formed in said tray, each said bush further protruding with a portion thereof below said tray, and wherein said portion of each bush having a lateral recess, starting from its lower end, which is adapted to allow rotation of said foot of the pin about said pivoting axis, starting from the extended condition of the pin in said raised position, in a single direction of rotation and wherein said recess further forms a lateral support for the foot of the pin, which is spaced downwardly from said pivoting axis of the foot of the pin in the raised position and in the extended condition of pin, during the rotation of the foot of the pin about said pivoting axis in the transition from the extended condition of the pin to the shortened condition of the pin, in order to produce the transition of the pin from the raised position to the lowered position; and said bush portion having said lateral recess on only a region thereof so as to comprise a non recessed area which contrasts the rotation of said foot about said pivoting axis in the opposite direction with respect to the direction of rotation allowed by said recess when said pin is in the extended condition and at least in the raised position or in a position which is intermediate between said raised position and said lowered position.

6. The apparatus of claim 4, further comprising stop means for stopping a lifting of said pin with respect to said tray which contrast an upward extraction of the pin from said seat.

7. The apparatus of claim 6, wherein said stop means comprise at least one axial shoulder which protrudes laterally from said foot of the pin and is engageable with a stop element which is formed by said bush in order to limit the lifting of said pin with respect to said tray to a position which is further raised with respect to said raised position, and wherein a lower end of said foot of the pin, when the pin is in said further raised position and in the extended condition, being flush with a lower end of the non recessed area of said bush.

8. The apparatus of claim 3, wherein said pins are provided aligned along parallel rows and mutually uniformly spaced along a same row for an alignment of the pins arranged in the different rows of pins.

9. The apparatus of claim 8, wherein said selection means comprise a horizontal supporting bar, which is parallel to the rows of pins and is positionable in each instance below a row of pins; said supporting bar being provided with a lower actuation element for each pin in a row of pins, and wherein said lower actuation element is activatable in order to interface with the foot of the overlying pin, in the extended condition of the pin and in the raised position, in order to produce transition of the pin from the extended condition to the shortened condition of the pin, with simultaneous transition from said raised position to said lowered position.

10. The apparatus of claim 9, comprising reset means which are adapted to engage the pins in the lowered position in order to actuate transition thereof to the raised position.

11. The apparatus of claim 10, wherein said reset means comprise a supporting bar which is adapted to be positioned in each instance below a row of pins, said supporting bar being provided with a lower actuation element for each pin of a row of pins, said lower actuation element being adapted to interfere with the foot of the overlying pin, which is supported in a position which is intermediate between said lowered position and said raised position and in the extended condition of the pin, in order to move said pin to the raised position.

12. The apparatus of claim 11, wherein said reset means are constituted by said selection means, said supporting bar being movable in a horizontal translational direction at right angles to the rows of pins with respect to said tray in order to actuate, through action of the activated lower actuation elements, the transition of pins from the raised position to the lowered position and in an opposite horizontal translational direction in order to actuate, through actuation of the activated lower actuation elements, the transition of pins from the lowered position to the raised position.

13. The apparatus of claim 12, wherein each of said lower actuation elements comprises: a side that is adapted to make contact with the foot of the pins during translational motion of said supporting bar in said horizontal translational direction and which is shaped as a vertical plane; and an opposite side, which is adapted to make contact with the foot of the pins during the translational motion of said supporting bar in said opposite horizontal translational direction, said opposite side being shaped like a plane which is inclined with respect to the vertical.

14. The apparatus of claim 3, wherein said elastic means are mounted on the stem of a said pin and are adapted to engage at least one abutment provided on side walls of the corresponding seat.

15. The apparatus of claim 14, wherein said elastic means comprise at least one wing which is associated with the stem of said pin and protrudes laterally in order to engage said at least one abutment, said wing being elastically flexible toward an axis of the pin in order to move beyond said abutment during transition of said pin from said raised position to said lowered position or vice versa.

16. The apparatus of claim 15, wherein said at least one wing is formed monolithically with said stem.

17. The apparatus of claim 15, wherein said at least one abutment is formed by a narrower portion of said seat located at said at least one wing.

18. The apparatus of claim 14, wherein said elastic means comprise a pair of wings which are associated with two mutually diametrically opposite lateral regions of the stem of said pin, said wings being flexible elastically toward an axis of the pin in order to move beyond said at least one abutment during transition of said pin from said raised position to said lowered position or vice versa.

19. The apparatus of claim 4, wherein said pin foot, in a lowered position, protrudes downwardly from a said respective bush so as to be contacted by a lower surface of the press, which produces a rotation of the foot of the pin in the lowered position for transition thereof from the extended condition to the shortened condition of the pin and forms a supporting surface for said foot of the pin in the extended condition and in the shortened condition of the pin, depending on whether the pin is in the raised position or in the lowered position.

20. The apparatus of claim 12, comprising sensing means for sensing a contour of the object deposited on said pins, said sensing means being functionally connected to said selection means for activation of the of the lower actuation elements for pins of said plurality of pins which are completely covered by said object during said one horizontal translational direction of said supporting bar.

21. The apparatus of claim 20, wherein said actuation elements are functionally connected to a programmable electronic actuation element which stores the contour of said object and is adapted to actuate said lower actuation elements at pins which are completely covered by said object during said one horizontal translational direction of said supporting bar.

22. The apparatus of claim 1, wherein said selection means are arranged in a positioning station which is located laterally with respect to the press to be served.

* * * * *